United States Patent [19]

Bellis et al.

[11] Patent Number: 4,830,082

[45] Date of Patent: May 16, 1989

[54] MACHINE AND METHOD FOR MAKING MOLDS USING AN ACTIVATING GAS

[75] Inventors: Kenneth E. Bellis, Rochester; Jackson E. Brown, Mt. Clemens; Pheroze J. Nagarwalla, Rochester Hills, all of Mich.

[73] Assignee: Roberts Corporation, Lansing, Mich.

[21] Appl. No.: 937,639

[22] Filed: Dec. 3, 1986

[51] Int. Cl.[4] ..... B22C 11/04; B22C 17/02

[52] U.S. Cl. ..... 164/16; 164/18; 164/158; 164/180; 164/228

[58] Field of Search ..... 164/16, 18, 37, 40, 164/44, 180, 192, 193, 200–202, 213, 169, 158, 228

[56] References Cited

U.S. PATENT DOCUMENTS 3,348,606 10/1967 Ptak et al. ..... 164/219

4,190,097 2/1980 Allread et al. ..... 164/16 X

*Primary Examiner*—Nicholas P. Godici

*Assistant Examiner*—J. Reed Batten, Jr.

*Attorney, Agent, or Firm*—Thomas K. Ziegler; Raymond J. Eifler

[57] ABSTRACT

A machine and method for making molds and mold cores (126) includes a pair of mold boxes (42*a*, 42*b*) removably mounted on a frame (60) for rotation between an upright, molding position in which molding material is introduced into the mold cavity of the mold boxes (42*a*, 42*b*) by a carrier (26) and an inverted discharge position in which the mold (126) is removed from the boxes by a mold receiving assembly (76). A pressure head assembly (46) both compresses molding material within the mold cavity and introduces a catalyst gas into the cavity for curing the molding material. A system for removing the spent gas from the mold cavity includes a pair of gas receiving chambers (122*a*, 122*b*) integral with the frame (60) which receives gas through the bottom of the mold boxes (42*a*, 42*b*) and an exhaust assembly (68, 70) which is selectively coupled with exhaust ports (124*a*, 124*b*) in the chambers (122*a*, 122*b*). A mold transfer carriage (84) transfer molds (126) discharged from the mold boxes (42*a*, 42*b*) to either of two lateral positions and can be employed to automatically change mold boxes (42*a*, 42*b*) which are mounted on the frame (60) by quick release connections (62, 64, 134).

20 Claims, 8 Drawing Sheets

MACHINE AND METHOD FOR MAKING MOLDS USING AN ACTIVATING GAS

The present invention broadly relates to molding machines for producing molds or cores, especially of the type in which the molding material must be activated or cured by a gas catalyst. More particularly, the present invention involves a molding machine including a system for introducing a catalytic gas into a mold cavity and for removing spent gas from the cavity.

One type of molding machine which is particularly well suited for making molds and cores from sand or similar material employs a mold box, means for filling the mold box with molding material and means for shifting the box between a molding position in which the molding material is compressed within the mold, to a discharge position in which the mold is removed from the box. In those applications where molding cores are to be formed with the machine, the molding material often comprises sand which is treated with a binder which, when activated, functions to bind the sand together to form the molded core. Molding machines of the type described above in which the sand is treated with a binder employ some form of means for activating the binder. For example, the binder may be activated by the use of heat or a chemical in the form of a gas. Machines which employ heat to activate the binder are generally referred to as "hot box" machines while those employing chemicals in the form of gas are referred to as "cold box" machines.

A typical "hot box" molding machine of the type described above is disclosed in detail in U.S. Pat. No. 3,348,606 entitled "Molding Machine Transfer Mechanism" issued Oct. 24, 1967. This prior patent discloses a machine in which a pair of mold boxes are mounted on a rotatable frame so that the mold boxes can be successively rotated between an upright, molding position and an inverted, mold discharge position. Such a machine has, in the past, been unsuitable for use with a "cold box" process because of the problems of introducing and removing the curing (catalyst) gas from the mold cavities.

SUMMARY OF THE INVENTION

This invention provides a machine from making molds using a gas for activating the molding material. The machine includes a frame which is mounted for rotation about a reference axis. At least one, and preferably two, mold boxes each having a mold cavity therein for forming a mold are mounted on the frame. Means are provided for rotating the frame so that the mold boxes are rotated between a molding position in which the gas activatable molding material is introduced into the box and a mold discharge position in which the mold is removed from the box. A molding material carrier is provided for introducing the molding material into a mold disposed in the molding position thereof. A pressure head assembly for compressing the molding material in an upright mold box also includes means for introducing the activating gas into the mold cavity. The frame includes at least one chamber which communicates with the interior of the mold box for receiving spent gas from the mold cavity. The frame is also provided with an exhaust port communicating with the chamber to allow extraction of spents gas from the frame. A shiftably mounted exhaust coupling disposed laterally of the frame is selectively shifted into coupling relationship with the exhaust port in order to create a partial vacuum in the exhaust chamber which in turn draws activating gas from the head assembly through the mold cavity and into the exhaust chamber.

Accordingly, one advantage of this invention lies in a system for drawing a catalyst gas through the mold cavity of a mold box which can be rotated to facilitate removal of a mold from the cavity.

Another advantage of this invention lies in a machine of the type described above wherein a plurality of mold boxes may be employed to increase production efficiency, and wherein a "cold box" process is employed to form molds.

Another advantage of this invention is to provide a machine employing a "cold box" process in which a catalytic gas is drawn under a partial pressure through the molding material in a mold box cavity in order to assure that a binder mixed with the molding material is thoroughly activated.

Another advantage of this invention lies in the use of a single exhaust and scrubbing system for treating spent gas exhausted from the mold cavities and multiple mold boxes.

BRIEF DESCRIPTON OF THE DRAWINGS

Figure 1:
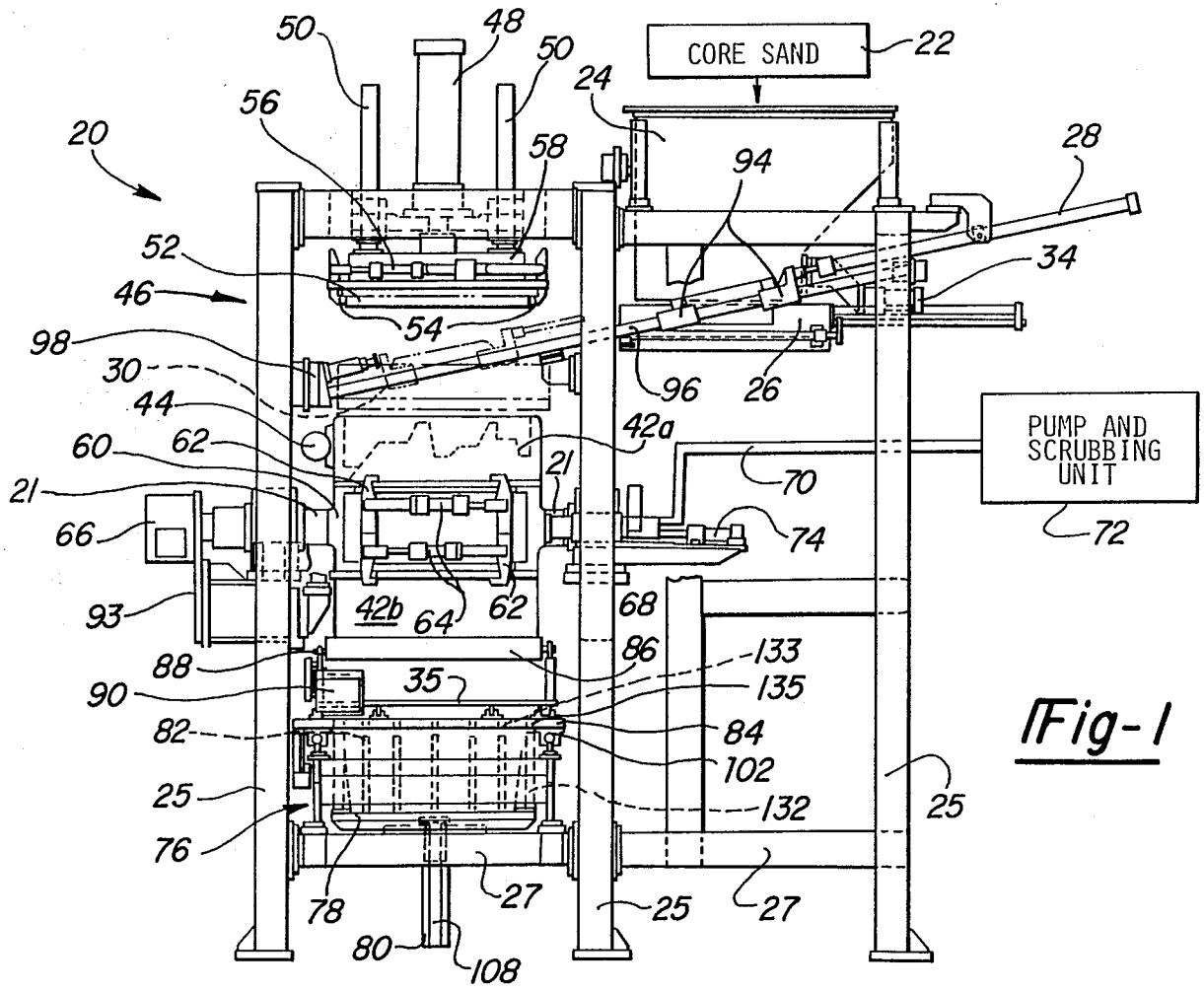
FIG. 1 is a front elevational view of a machine for making molds which forms the preferred embodiment of the present invention, the operating position of the sand carrier being indicated in the phantom.
Figure 2:
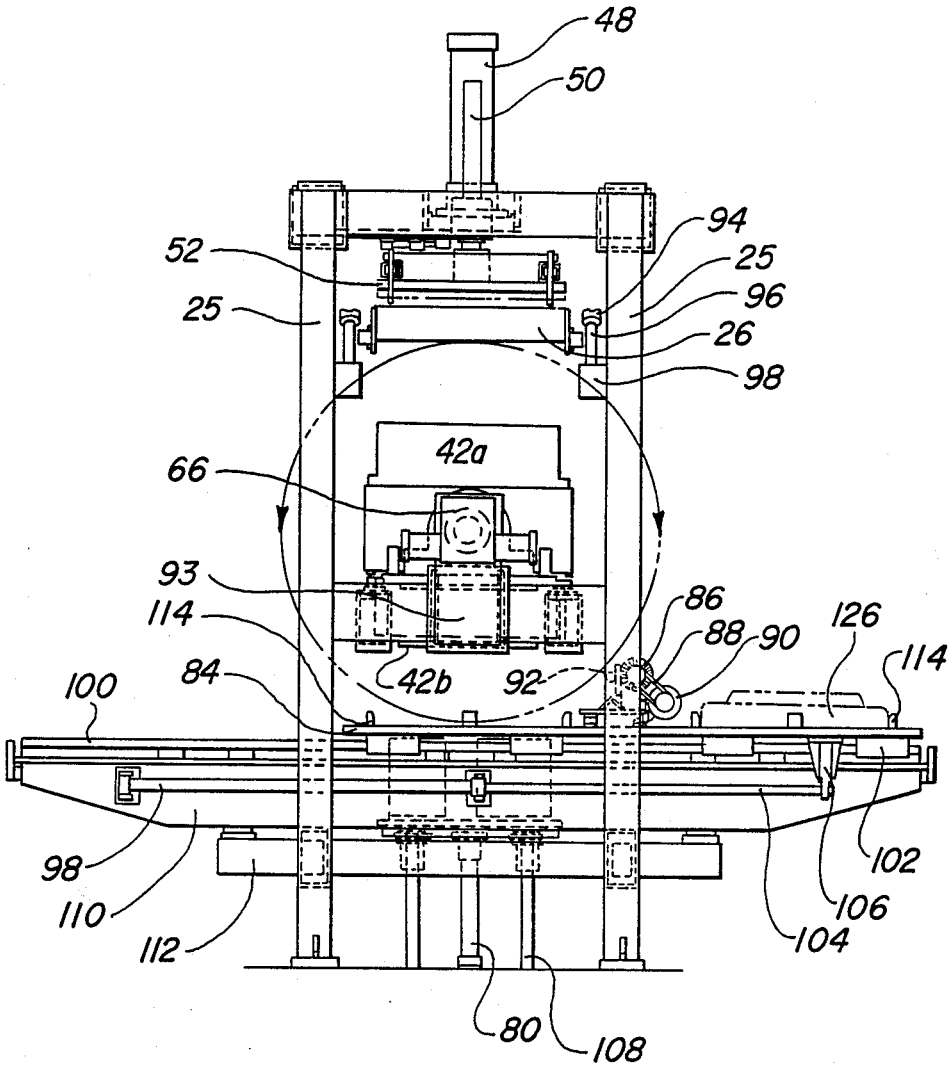
FIG. 2 is a side elevational view of the machine shown in FIG. 1.

Referring now to the drawings, FIGS. 1 and 2 illustrate a machine generally indicated by the numeral 20 for forming molds. The molds may be an end product, or may be "cores" which are employed in subsequent molding and casting processes. The machine 20 includes a supporting frame comprising upright frame members 25 joined together by horizontal frame members 27. A mold box frame 60 is mounted for rotation about an essentially horizontal axis by means of trunnions 21 which in turn are secured to the horizontal frame members 27. The frame 60 is rotated by means of a conventional rotary actuator 66 which is mounted on a bracket 93.

Mounted on opposite sides of the frame 60 are a pair of mold boxes 42*a*, 42*b*, each having a mold cavity configured to form the desired mold or core. The mold boxes 42*a*, 42*b* are releasably mounted on the frame 60 by means of a quick release mechanism comprising clamps 62 which are individually controlled by hydraulic cylinders 64. A conventional vibrator 44 may be mounted on each of the mold boxes 42*a*, 42*b* for the purpose of vibrating the corresponding mold box to encourage settling and compacting of molding material therein.

As will be discussed later, the frame 60 is in the form of a housing having exhaust chambers therein which may be connected with an exhaust line 70 by means of an exhaust coupling 68. The exhaust coupling 68 is positioned laterally of the frame 60 and is reciprocated horizontally by means of a hydraulic cylinder 74, between a standby position in which the frame 60 is free to rotate, and an operating position in which the exhaust coupling 68 is connected with the frame 60 when the latter is stationary. The exhaust line 70 is connected with a pump and scrubbing unit 72 of conventional design which draws spent exhaust gas from the frame 60.

As will be discussed below, the tops of the mold boxes 42a, 42b are open so as to allow molding material to be introduced therein and to permit a finished mold or core to be removed therefrom. The mold boxes 42*a*, 42*b* are each rotatable along with the frame 60 from an upright, molding position to an inverted, discharge position. As shown in FIGS. 1 and 2, the mold box 42*a* is in the molding position thereof and the mold box 42*b* is in the discharge position thereof.

Mounted on the frame members 25, 27 is a hopper 24 into which molding material such as sand is introduced from a source 22 thereof. The sand or other molding material includes a binding agent of a conventional type which can be activated by a catalyst gas to bind the sand and thereby form a mold or core. A hydraulic cylinder 34 controls a later discussed gate to allow sand to flow from the bottom of the hopper 24 into a sand carrier 26. The sand carrier 26 is mounted for inclined lateral movement between a standby position as shown in FIG. 1 in which sand may be introduced therein from the hopper 24 to an operating position immediately above the mold box 42*a*. The sand carrier 26 is mounted on a pair of inclined guide rods 96 secured to brackets 98, by means of bushings 94. The sand carrier 26 is driven between its operating and standby positions by a hydraulic cylinder 28.

Mounted immediately above the rotating frame 60 is a pressure head assembly indicated by the numeral 46. The pressure head assembly 46 includes a manifold head 58 driven for vertical reciprocation by a hydraulic cylinder 48 and guided in its vertical movement by guide rods 50. A gassing/press plate 52 is removably mounted on the bottom face of the manifold head 58 by means of a quick release mechanism comprising clamps 54 which are controlled by hydraulic cylinders 56.

Disposed beneath the rotating frame 60 is a horizontally extending support table 110 which extends laterally beyond the upright frame members 25, as best seen in FIG. 2. The support table 110 is in turn mounted on a cross frame 112 which is secured to the upright frame members 25. A pair of spaced apart guide rods 100 are secured to the upper face of the support table 110. A horizontal mold transfer carriage 84 which may comprise a plate is mounted on the guide rods 100 by means of bushing assemblies 102 so as to move laterally beneath the rotating frame 60. The transfer carriage 84 is driven on the guide rods 100 by means fo a hydraulic cylinder 98 having an output piston rod 104 connected to the carriage 84 by a bracket 106. Mounted on the upper face of the transfer carriage 84 are two sets of locating pins 114 whose purpose will be described below. The transfer carriage 84 has a length sufficient to define two sections which respectively accommodate two molds or cores: one mold 126 disposed on one section of the carriage 84 immediately beneath the rotating frame 60, and the other mold 126 disposed laterally outboard on the second section of the carriage 84 so that access may be had to the outboard mold while a subsequently formed mold is being deposited on the transfer carriage 84.

Mounted on the upper surface of the transfer carriage 84, between the two sets of locating pins 114 is a support bracket 35. A cylindrical brush 86 is mounted for rotation on the bracket 35 and is driven by a conventional motor 90 via a belt 88. Also mounted on the bracket 35 is an air distribution pipe 92 which is connected with a suitable source of pressurized air (not shown) and includes upwardly facing apertures (not shown) therein so that compressed air flows upwardly from the pipe 92, along essentially its entire length.

Positioned below the transfer carriage 84 is a mold receiving and transfer assembly generally indicated by the numeral 76. The mold receiving and transfer assembly 76 includes a support 78 driven for vertical reciprocation by a hydraulic cylinder 80 and guided in its vertical movement by rods 108. Mounted on the upper face of the support 78 are a plurality of vertically extending essentially U-shaped mold support fingers 82. Also mounted on the upper face of the support 78 are a pair of spaced apart mold box support arms 132 which are adapted to engage and support each of the mold boxes 42*a*, 42*b* during changeover of such mold boxes, as will be discussed later in more detail. The transfer carriage 84 includes a plurality of elongate openings 133 therein which register with the fingers 82 and which register with support arms 132 so that the fingers 82 and support arms 132 may pass upwardly through the carriage 84.

The control system for operating the various parts of the machine 20 is of a conventional design and may be of the general type, for example, disclosed in U.S. Pat. No. 3,348,606, consequently, the details of such a system need not be discussed herein.

Figures 3, 4:
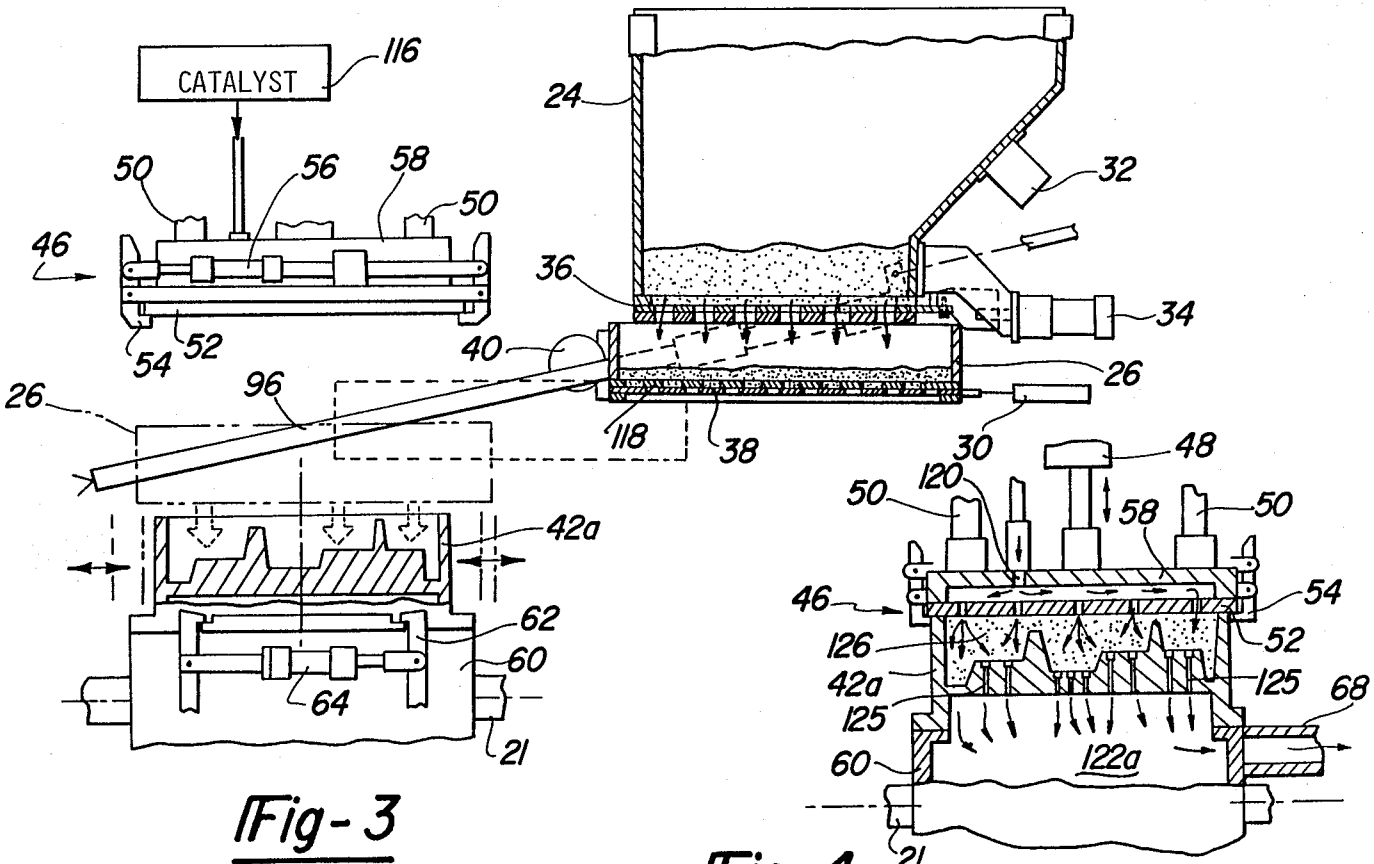
FIG. 3 is a fragmentary, sectional view showing the sand carrier in operative relationship to the press head assembly and mold box.
FIG. 4 is a fragmentary, sectional view depicting the press head assembly in an operating position and showing the flow path of the activating gas.

FIG. 3 illustrates the hopper 24 and sand carrier 26 in more detail. Sand introduced into the top of the hopper 24 is drawn to the bottom thereof by the influence of gravity, aided by a suitable vibrator 32 mounted on the wall of the hopper 24. The bottom of the hopper 24 is perforate and includes a hopper gate 36 controlled by the hydraulic cylinder 34 to allow sand in the hopper 24 to flow into the generally rectangular sand carrier 26. A vibrator 40 is mounted on a sidewall of the sand carrier 26 to aid in discharging sand from the carrier 26 into the mold cavity of a mold box such as mold box 42*a* disposed in the molding position thereof. The sand carrier 26 includes a perforate bottom wall 118 beneath which there is provided a sand carrier gate plate 39 which is controlled by hydraulic cylinder 30. The manifold head 58 is coupled with a source of catalyst gas 116.

FIG. 4 illustrates the operation of the pressure head assembly 46 during the pressing and gassing operation. The catalyst gas from the source 116 flows into the hollow interior of the manifold head 58 and then outwardly through apertures in the plate 52 into the molding cavity of the mold box 42*a*. The bottom of each of the mold boxes 42*a*, 42*b* includes a plurality of passageways 125 therein which place the mold cavity in gas flow communication with exhaust chambers in the frame 60, one of such chambers being designated by the numeral 122*a* in FIG. 4.

Figure 5:
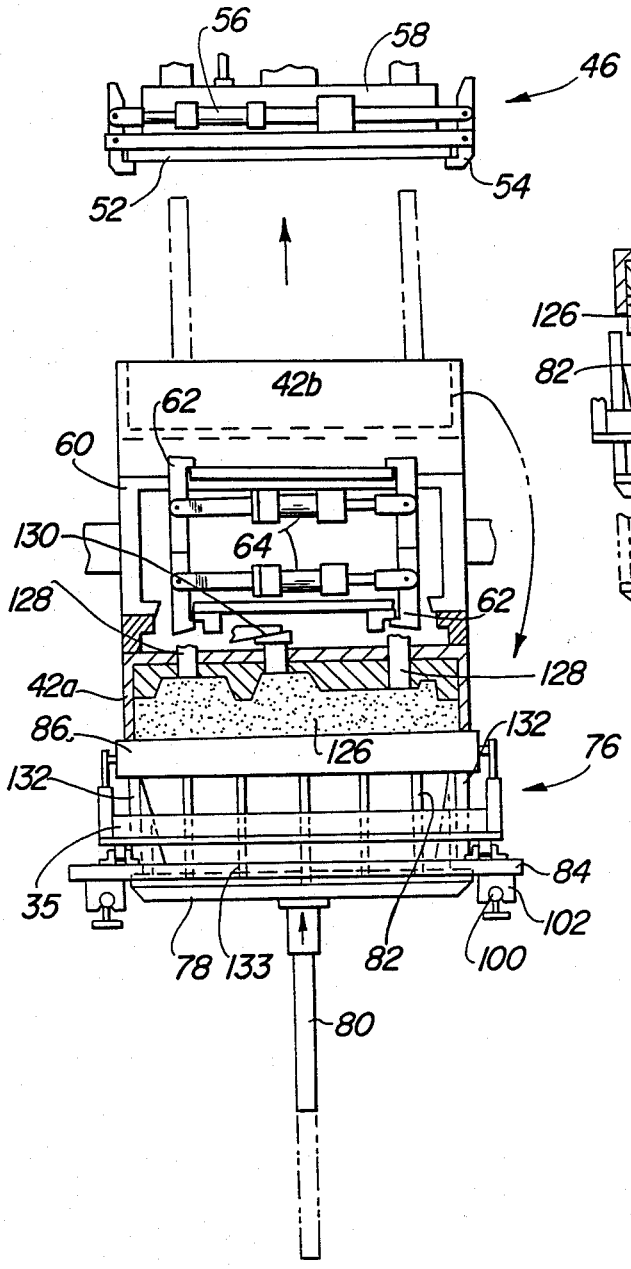
FIG. 5 is a front view, partially in section, of a portion of the machine and depicting a mold being discharged from a mold box.

FIG. 5 depicts the frame 60 having been rotated 180 degrees so that the mold box 42*a* is in its inverted, discharge position. FIG. 5 also depicts an ejection mechanism for ejecting the mold 126 from the box 42*a*. Various types of ejector assemblies may be satisfactorily employed, one such ejector system being shown in U.S. Pat. No. 3,348,606 mentioned hereinabove. Thus, it is not necessary to disclose the details of such an ejector assembly herein. However generally, such an assembly will include a plurality of ejector pins 128 which are actuated by a cam assembly 130 for example, and which extend through the bottom of the molding box 42*a* so as to engage the mold 126 and force the latter downward while the mold 126 is supported by the mold supporting fingers 82.

Figure 6:
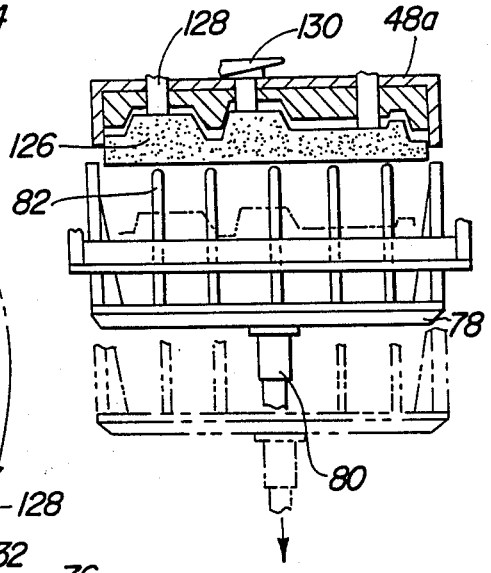
FIG. 6 is a view similar to FIG. 5 but at a later interval during the discharge of the mold.

As shown in FIG. 6, the downward movement of the support 78 and fingers 82 is synchronized with the displacement of the ejector pins 128 so that the mold 126 has ejection pressure evenly supplied thereto while being supported at all times by the fingers 82.

Figure 7:
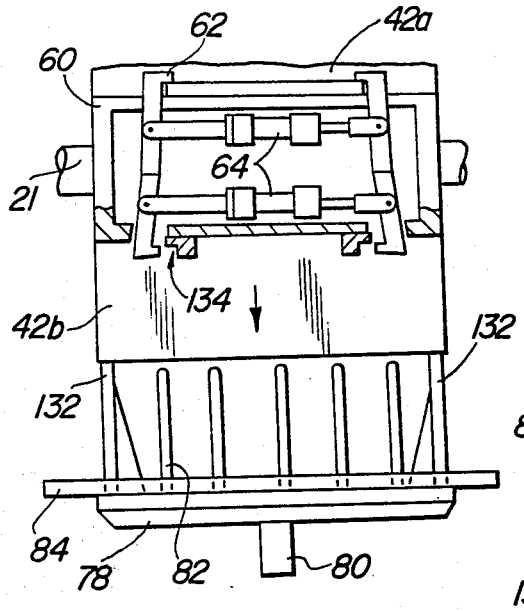
FIG. 7 is a fragmentary, front elevational view of a portion of the machine depicting an initial step in removing a mold box from the rotating frame.
Figure 8:
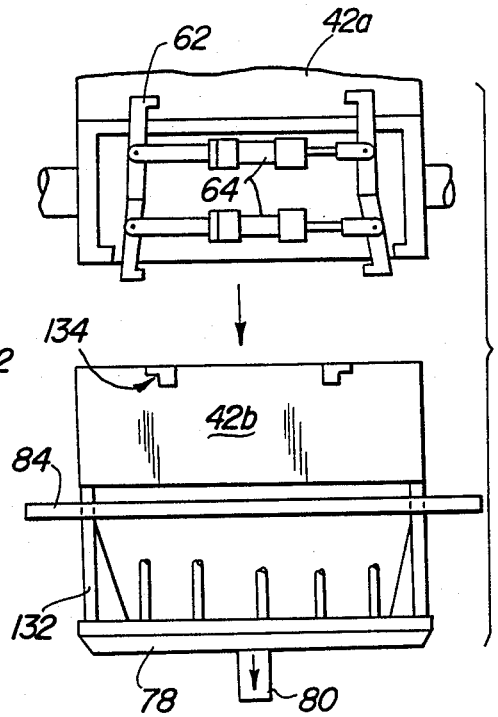
FIG. 8 is a view similar to FIG. 7 but depicting a mold box being lowered onto the transfer carriage.

FIGS. 7 and 8 illustrate the manner in which the mold boxes 42*a*, 42*b* can be removed from the rotating frame 60. Each of the mold boxes 42*a*, 42*b* is provided with a locking member 134 which matably engages with the clamps 62. The clamps 62 are disengaged and shifted free of the locking members 134 by means of the hydraulic cylinder 64. Prior to releasing a mold box 42*b* while the latter is in the discharge position thereof, the support 78 is elevated until the support arms 132 contact the bottom of the mold box 42*b*. FIG. 8 depicts the support 78 as having been lowered so as to lower the mold box 42*b* onto the transfer carriage 64.

Figure 9:
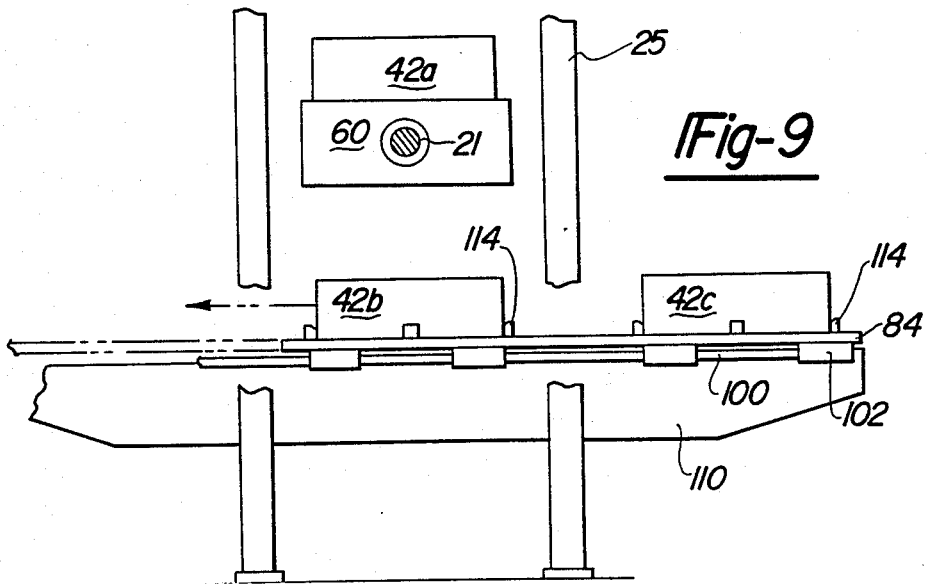
FIG. 9 is an essentially diagrammatic front view of the machine during changing of the mold boxes.

FIG. 9 depicts the mold box 42*b* as having been lowered onto the transfer carriage 84. The mold box 42*b* is received within the locating pins 114. A third mold box 42*c* is positioned on one end of the transfer carriage 84 in a preselected position determined by the locating pins 114.

Figure 11:
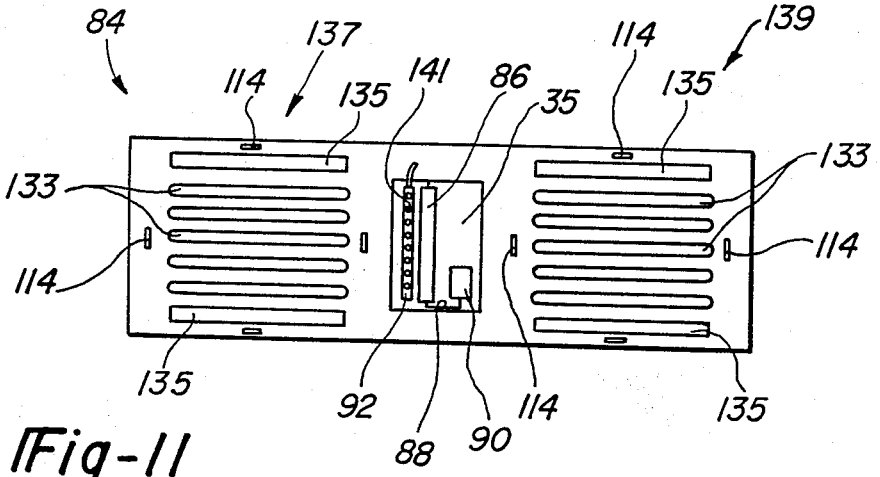
FIG. 11 is a plan view of the mold transfer carriage.

FIG. 11 illustrates the details of the mold transfer carriage 84. The carriage includes first and second longitudinally spaced sections 137 and 139 respectively upon each of which a mold (not shown) or a mold box (not shown) can be supported. Each section 137, 139 of the carriage 84 includes a first set of longitudinal extending, elongate openings 133 therein through which the mold support fingers 82 (FIG. 1) may extend, as well as a second set of outboard, longitudinally extending openings 135 through which the mold support arms 132 (FIG. 1) may extend. The brush 86 and air pipe 92 extend parallel to each other and transverse to the path of travel of the carriage 84. The air pipe 92 is shown as having spaced apart, upwardly facing apertures 141 therein through which pressurized air may pass.

Figure 10:
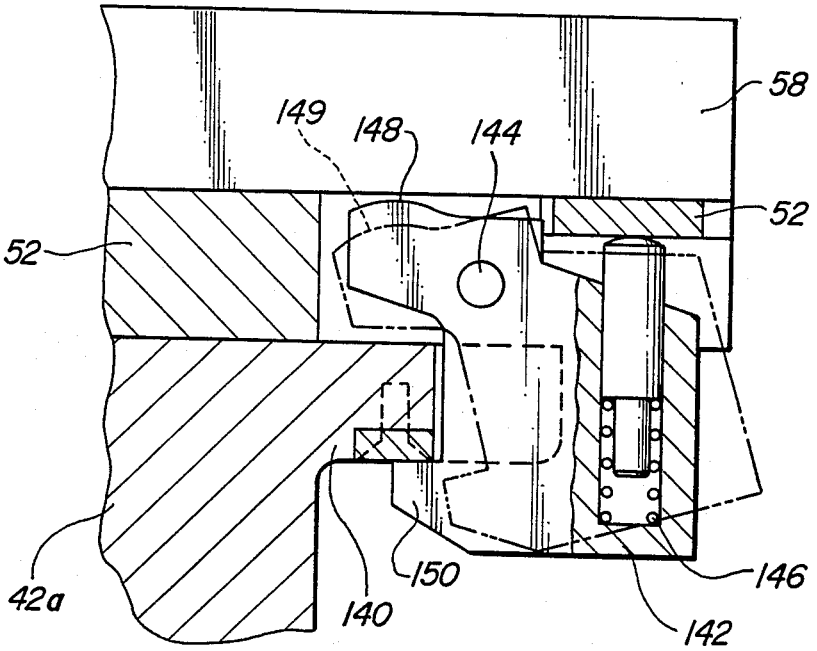
FIG. 10 is an enlarged, fragmentary view, taken partially in section and showing a mechanism for automatically clamping the gassing/press plate on a mold box.

FIG. 10 depicts the details of a mechanism for releasably clamping the gassing press/plate 52 to the top of one of the core boxes, such as core box 42*a*. A plurality of clamping members 142 are pivotally mounted by means of corresponding pivot pins 144 around the periphery of the gassing/press plate 52. Each of the clamping members 142 includes a hook portion 150 which is adapted to engage the bottom side of a peripheral shoulder 140 of the mold box 42*a*. The clamping members 142 also include a camming surface 148 which is adapted to be engaged by a downwardly extending cam button 149 on the bottom of the gassing/press plate 52. A spring assembly 146 is provided for normally biasing the clamping member 142 to pivot clockwise as viewed in FIG. 10.

Figure 12:
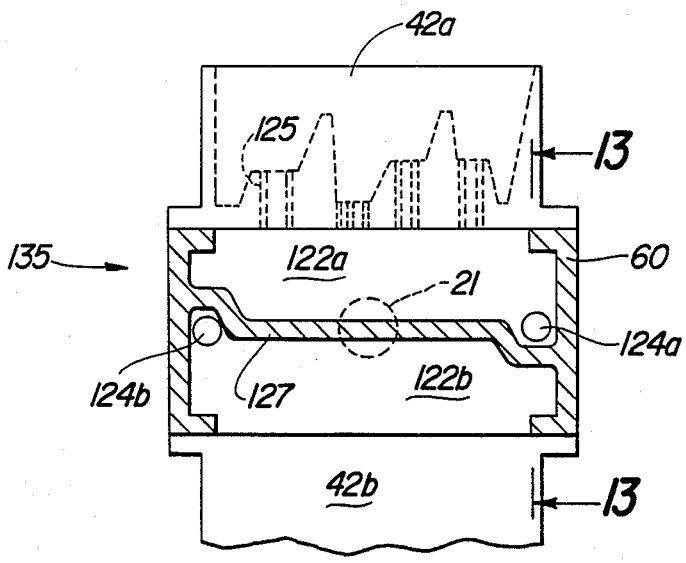
FIG. 12 is a sectional view of the frame depicting the exhaust chambers in operative relationship to the corresponding mold boxes.
Figure 13:
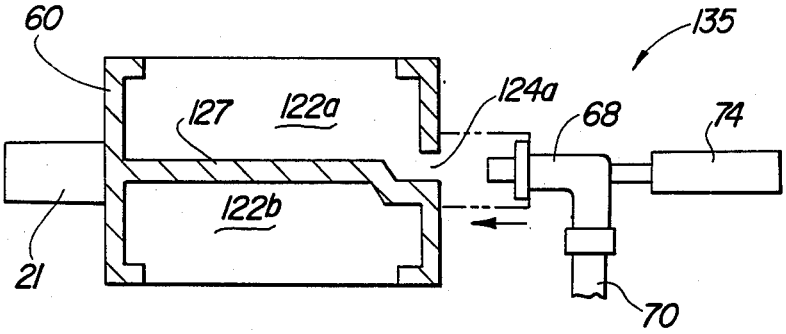
FIG. 13 is a sectional view taken along the line 13—13 in FIG. 12.

FIGS. 12 and 13 depict the details of a means 135 for removing spent gas from the mold cavities of the mold boxes 42*a*, 42*b*. The gas removing means 135 includes a pair of exhaust chambers 122*a*, 122*b* defined in the housing-like rotating frame 60. The exhaust chambers 122*a*, 122*b* are separated by a partition 127. The bottom faces of the mold boxes 42*a*, 42*b* form one wall of the corresponding exhaust chambers 122a, 122b. The mold cavities of the mold boxes 42*a*, 42*b* communicate with the corresponding chambers 122*a*, 122*b* by means of passageways 125 in the bottom of the corresponding mold boxes 42*a*, 42*b*. The frame 60 includes a pair of lateral exhaust ports 124*a*, 124*b* which communicate with the associated chambers 122*a*, 122*b*. These exhaust ports 124*a*, 124*b* are equally radially spaced from the axis of the trunnion 21 so that they trace the same circular path upon rotation of the frame 60. The gas exhaust coupling 68 is positioned on one side of the frame 60 and at a position radially spaced from the axis of the trunnion 21 so as to be aligned with the rotational path of the ports 124*a*, 124*b* associated with the mold boxes 42*a*, 42*b* which are disposed at the upright molding position thereof. The hydraulic cylinder 74 shifts the exhaust coupling 68 from a standby position to an operating position in which the exhaust line 70 is connected with the corresponding exhaust chamber 122*a*, 122*b*.

Figure 14:
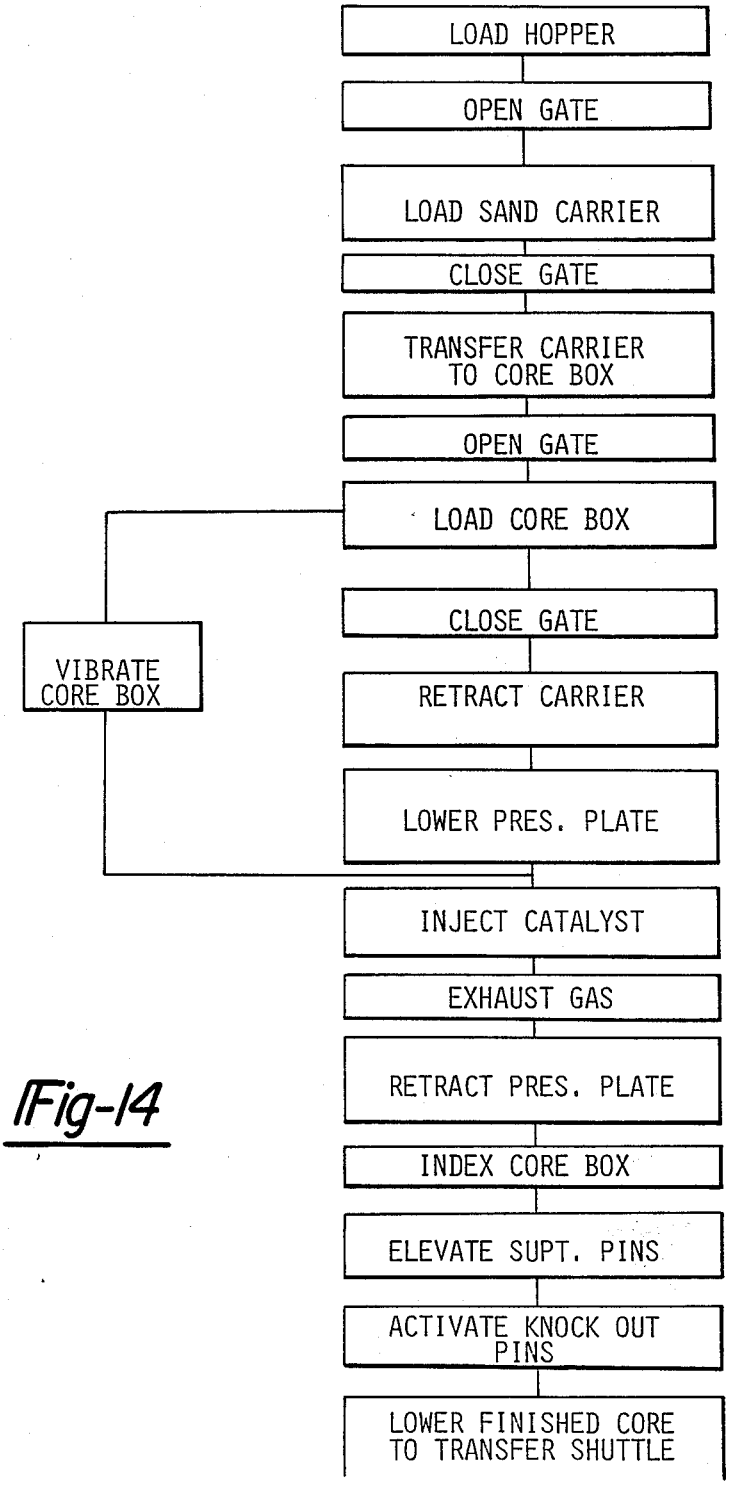
FIG. 14 is a flow chart of the steps in the operation of the machine.

FIG. 14 depicts the steps involved in a typical molding operation which will be discussed below in connection with a description of the operation of the machine.

OPERATION

Referring to FIGS. 1, 2 and 3, sand is first loaded into the hopper 24 following which the hopper gate 36 is opened by the cylinder 34 to place a charge of sand in the carrier 26. The hopper gate 36 is then closed. The cylinder 28 is actuated to move the carrier 26 from its normal, standby position to an operating position disposed immediately above the mold box 42*a*. With the sand carrier positioned immediately above the mold box 42*a*, cylinder 30 is actuated to open the carrier plate 38 and allow sand within the carrier to fall into the open mold cavity of the mold box 42*a*. The vibrator 40 may be energized to increase the flow of sand from the carrier 26 into the mold box 42*a*. While the mold box 42*a* is being loaded with sand from the carrier 26, the vibrator 44 may be energized to vibrate the mold box 42*a* and thereby aid in the settling and compacting of the sand therewithin. Typically, the entire mold cavity of the mold box 42*a* is filled and preferably, the deposited sand may extend slightly above the top of the mold box 42*a*. The carrier plate gate 38 is then closed and the carrier 26 is retracted from its operating position to its standby position.

The pressure head assembly 46 is then lowered as shown in FIG. 4 until the gassing/press plate 52 engages the sand extending above the top of the mold box 42*a* and forces the sand downwardly thereby compacting the sand to some extent within the mold cavity. With the sand within the mold cavity having been compacted, catalyst gas from the source 116 then flows into the manifold head 58 and out through the openings in the gassing/press plate 52 and into the mold cavity. As discussed above, the catalyst gas functions to activate the binder which has been mixed with the sand thereby resulting in the sand becoming bound together to form a mold or core Referring to FIGS. 1, 12 and 13, the cylinder 74 is activated to shift the exhaust coupling 68 into the exhaust port 124a. The pump and scrubbing unit 72 is activated in order to create a partial vacuum in the exhaust chamber 122*a*. This partial vacuum functions to draw spent gas in the mold cavity downwardly through the passageways 125 into the exhaust chamber 122*a* and then through the port 124*a* into the exhaust line 70. The spent gas is then cleansed by a conventional scrubbing unit 72.

After a sufficient quantity of gas has been introduced into the mold cavity, the pressure head assembly 46 is retracted to its elevated position and the frame 60 is rotated 180° so that the mold box 42*a* having the finished mold 126 therein is positioned in an inverted discharge position and the empty mold box 42*b* is positioned in the upright, molding position, as shown in FIG. 5. Referring now to FIG. 5, the support 78 is moved upwardly until the fingers 82 engage or are in close proximity to the mold 126. The ejector pins 128 are then actuated to force the mold 126 downwardly. Simultaneous with the actuation of the ejector pins 128, the support 78 is moved downwardly in synchronism with the downward movement of the ejector pins 128 so that the mold 126 is supported at all times while it is being ejected from the mold cavity. The support 78 continues its downward movement until the mold 126 comes to rest on the transfer carriage 84. With the mold 126 resting on one end of the transfer carriage 84, the cylinder 98 is actuated to shift the transfer carriage 84 in one direction along the guide rods 100. It should be noted here that since the transfer carriage 84 is sufficiently long to accommodate two molds 126, the ejected mold may be transferred either to the left or to the right side of the machine 20. FIG. 2 depicts the position of the transfer carriage 84 after it has transferred a mold 126 to the right side of the machine 20. The mold 126 is then removed either manually or with suitable automatic handling equipment. Note also, as shown in FIG. 2 that the left end of the transfer carriage 84 is readied beneath the rotating frame 60 in preparation for receiving the next mold 126. Thus, it is not necessary to delay forming the next mold and ejecting it onto the transfer carriage 84 until the previous mold has been removed from the transfer carriage 84.

Referring particularly to FIGS. 1 and 2, it is highly desirable to clean the outer face of a mold box 42*a*, 42*b* after a mold 126 has been formed therein and discharged therefrom. This cleaning operation is performed by the brush 86 and air pipe 92. After a mold 126 has been discharged from the inverted mold box 42*b*, the motor 90 is energized thereby turning the brush 86. As the transfer carriage 84 moves along the guide rods 100, the rotating brush 86 comes in contact with and brushes or sweeps away material on the face of the core box 42*b*. At the same time, pressurized air exiting from the air pipe 92 blows into the mold cavity thereby assisting in removing residual sand therefrom. During the interval in which a mold 126 is being discharged from an inverted mold box 42*a* the molding process is repeated for the molding box 42*b* which is in the upright, molding position. It may thus be appreciated that the machine 20 maximizes productivity.

In addition to automatically forming and removing molds 126, the machine is also capable of automatically changing tooling consisting of the gassing/press plate 52 and the mold boxes 42*a*, 42*b*. This mode of operation is depicted in FIGS. 7, 8 and 9. When it is desired to change or replace one of the mold boxes 42*a*, 42*b* such box is first rotated to its inverted, discharge position, as shown in FIG. 7. The cylinders 64 are then activated to release the clamps 62 from the locking members 134. Prior to unlocking the clamps 62, the support 78 is moved upwardly until the support arms 132 contact and support the core box 42*b*. After the clamps 62 have been unlocked, the support 78 is moved downwardly until the core box 42*b* engages and comes to rest on the top of the transfer carriage 84. As shown in FIG. 9, with the core box 42*b* positioned on one end of the transfer carriage 84, the latter may be moved to the left to position a new mold box 42*c* in registered relationship immediately beneath the rotating frame 60. The support 78 is again elevated until the support arms 132 engage the bottom face of the new mold box 42*c*. Continued upward movement of the support 78 moves the new mold box 42*c* into position in engagement with the rotating frame 60. The corresponding hydraulic cylinder 64 is then activated to move the clamps 62 into locking relationship with the locking members 134, thereby securing the new mold box 42*c* in place. With the new mold box 42*c* in place, the frame 60 is rotated 180° and the mold box 42*a* is removed in a manner similar to that described above with respect to mold box 42*b*. After at least one of the mold boxes 42*a*, 42*b* have been removed from the transfer carriage 84, a fourth mold box (not shown) is placed on the transfer carriage 84 in a preselected position determined by the locater pins 114. The transfer carriage 84 is then shifted until the fourth mold box is positioned beneath the frame 60. The fourth mold box is mounted on the frame 60 is the manner described above with respect to mold box 42*c*.

Referring now to FIGS. 1, 2 and 10, in some cases it may be desirable or necessary to replace the gassing/press plate 52 with another of such plates that may be differently configured. This can be automatically performed by the machine 20 of the present invention by lowering the press head assembly 46 until the plate 52 engages the top of one of the mold boxes 42*a* and the buttons 149 engage the cam surface 148 to open the clamps 142. The cylinder 56 is then activated to release the clamps 54 which hold the plate 52 on the manifold head 58. Thereafter, when the press head assembly 46 moves upwardly, the springs 146 close the clamps 142 to lock the gassing/press plate 52 onto the mold box 42*a*. Thus, when the mold box 42*a* is rotated to its discharge position in preparation for removing it from the frame 60, the plate 52 is attached thereto and the plate 52 and mold box 42*a* are removed as a single unit from the frame 60.

We claim:

1. A machine for making molds using an activating gas, comprising:

a frame (60);

first means (21, 25) for mounting said frame (60) for rotation about a reference axis;

at least first and second mold boxes (42*a*, 42*b*) each having a mold cavity for forming a mold (126) therein;

second means (62, 64, 134) for mounting said mold boxes (42*a*, 42*b*) on said frame (60);

third means (66) for rotating said frame (60) such that said mold boxes (42*a*, 42*b*) may be rotated between a mold position in which gas activatable molding material is introduced into one of said mold boxes (42*a*) and a discharge position in which a mold (126) may be removed from the other of said mold boxes (42*a*, 42*b*);

fourth means (26) for introducing said molding material into each of said mold boxes (42*a*, 42*b*) when each of said said mold boxes is in said molding position;

fifth means (46) for introducing activating gas into said mold boxes (42*a*, 42*b*) to activate said molding material; and, sixth means (135) for removing said activating gas from said mold boxes (42*a*, 42*b*), including a first chamber (122*a*) on said frame (60) for receiving said gas from said first mold box (42*a*) and means for connecting said mold cavity of said first mold box (42*a*) with said first chamber (122*a*) for removing said activating gas from said first mold box and a second chamber (122*b*) on said frame (60) for receiving said gas from said second mold box (42*b*) and means for connecting said mold cavity of said second mold box (42*b*) with said second chamber (122*b*) for removing said activating gas from said second mold box (42*b*).

2. The machine of claim 1, wherein said first and second chambers (122*a*, 122*b*) are disposed in side-by-side relationship to each other.

3. The machine of claim 1, wherein said first and second chambers (122*a*, 122*b*) respectively include first and second exhaust ports (124*a*, 124*b*) disposed laterally in said chambers (122*a*, 122*b*).

4. The machine of claim 3, wherein said exhaust ports (124*a*, 124*b*) are radially spaced from said reference axis essentially the same distance.

5. The machine of claim 4, wherein said sixth means (135) includes:

an exhaust coupling (68) selectively connectable with each of said exhaust ports (124*a*, 124*b*);

means (74) connected with said exhaust coupling (68) for shifting said exhaust coupling (68) into and out of connection with each of said exhaust ports (124*a*, 124*b*); and means (72) coupled with said exhaust coupling (68) for pumping gas from each of said chambers (122*a*, 122*b*) through said exhaust coupling (68).

6. The machine of claim 5, including means for cleaning the gas removed from said exhaust chambers (122*a*, 122*b*) through said exhaust coupling (68).

7. The machine of claim 1, wherein said frame (60) includes a housing and said chambers (122*a*, 122*b*) are defined by said housing.

8. The machine of claim 1, wherein said first and second mold boxes (42*a*, 42*b*) are mounted on first and second opposite sides of of said frame (60) such that said mold boxes (42*a*, 42*b*) are circumferentially spaced apart essentially 180° about said reference axis.

9. The machine of claim 1, wherein:

said reference axis extends essentially horizontal, said molding position is disposed above said discharge position, and each of said mold boxes (42*a*, 42*b*) includes an open side into which said molding material may be introduced and from which said mold may be removed, said open side of each of said boxes (42*a*, 42*b*) facing essentially upward when the associated mold box is in said molding position thereof and facing essentially downwardly when the associated mold box is in said discharge position thereof.

10. The machine of claim 9, wherein said fourth means (26) includes:

a carrier (26) adapted to hold a quantity of said molding material;

means (94, 96) for mounting said carrier (26) for lateral movement between a standby position laterally spaced from said molding position of said mold boxes (42*a*, 42*b*) and a discharge position disposed in vertical registration above a mold box in said molding position thereof; and, means (24) for charging said carrier (26) with a quantity of said molding material.

11. The machine of claim 10, wherein said means (94, 96) for mounting said carrier (26) includes a pair of inclined support rails (96) for guiding the movement of said carrier (26), and said standby position of said carrier (26) is at an elevation higher than said discharge position of said carrier (26).

12. The machine of claim 10, wherein said carrier (26) includes a discharge opening in the bottom thereof through which said molding material may be discharged into said mold boxes (42*a*, 42*b*), a closure means (38) shiftably mounted on said carrier (26) for selectively closing said discharge opening and motor means (30) connected with said closure means for shifting said closure means.

13. The machine of claim 10, including:

a press assembly (46) including a press member (52) for compacting said molding material within each of said mold boxes (42*a*, 42*b*), and means (48, 50) for mounting said press assembly for vertical reciprocation above said frame (60) such that said press member (52) is reciprocated between a standby position spaced above a mold box (42*a*) in said molding position and an operating position in which said press member (52) contacts and compresses the molding material within the mold box (42*a*) at said molding position.

14. The machine of claim 13, wherein:

said fifth means (46) includes a head (58) carried by said press assembly (46) and defining a manifold into which said gas may be introduced from a source (116) thereof, and said press member (52) includes at least one aperture therein through which said gas may flow from said manifold into said mold boxes (42*a*, 42*b*) when said press assembly (46) is in said operating position thereof.

15. The machine of claim 13, wherein said press assembly (46) includes a head (58) and quick release means (54, 56) for releasably mounting said press member (52) on said head (58) whereby said press member (52) can be quickly changed.

16. The machine of claim 15, wherein said press member (52) is defined by a plate having a lower face provided with a preselected contour for engaging molding material in one of said mold boxes (42*a*, 42*b*), said plate including a plurality of apertures therein through which said gas may flow from a source (116) thereof into said molding material.

17. The machine of claim 15, including means (140, 142, 146) for latching said press member (52) to at least one (42*a*) of said mold boxes (42*a*, 42*b*) when said press member (52) is released from said head (58).

18. The machine of claim 1, wherein said second means (62, 64, 134) includes a quick release connection (62, 134) between each mold box (42*a*, 42*b*) and said frame (60) and a motor member (64) on said frame (60) for operating said quick release connection (62, 134) to quickly release said mold boxes (42*a*, 42*b*) from said frame (60).

19. A method for making molds using an activating gas, said method comprising the steps of:

(1) releasably mounting first and second mold boxes to a frame mounted for rotation about a reference axis, each of said mold boxes having a mold cavity for forming a mold therein;

(2) rotating said frame such that said mold boxes rotate between a mold position in which gas-activatable molding material may be introduced into one of said mold boxes and a discharge position in which a mold may be removed from the other of said mold boxes.

(3) introducing gas-activatable molding material into said one mold box while in said mold position;

(4) introducing activating gas into said one mold box to activate said molding material while said one mold box is in said mold position;

(5) removing said activating gas from said one mold box after sufficient curing time has lapsed;

(6) removing a mold from said other mold box while said other mold box is in said discharge position;

(7) repeating steps (2) through (6) to form a plurality of molds.

20. The method of claim 19, wherein step (5) includes the step of shifting a pumping means into operative engagement with an exhaust port in a chamber operatively coupled with said one mold box for pumping said activating gas from said one mold box through said chamber.

* * * * *